US009934705B2

(12) United States Patent
Spiro et al.

(10) Patent No.: US 9,934,705 B2
(45) Date of Patent: Apr. 3, 2018

(54) LAMINATED LENTICULAR LABEL FOR CURVED CONTAINERS

(71) Applicant: Tracer Imaging LLC, White Plains, NY (US)

(72) Inventors: Steven M. Spiro, Chappaqua, NY (US); Stephen S. Daniell, Northampton, MA (US)

(73) Assignee: TRACER IMAGING LLC, White Plains, NY (US)

( * ) Notice: Subject to any disclaimer, the term of this patent is extended or adjusted under 35 U.S.C. 154(b) by 76 days.

(21) Appl. No.: 14/932,499

(22) Filed: Nov. 4, 2015

(65) Prior Publication Data

US 2016/0140881 A1 May 19, 2016

Related U.S. Application Data

(60) Provisional application No. 62/123,040, filed on Nov. 5, 2014.

(51) Int. Cl.

| | |
|---|---|
| ***G09F 3/10*** | (2006.01) |
| ***B65C 3/14*** | (2006.01) |
| ***G09F 19/14*** | (2006.01) |
| *G09F 23/00* | (2006.01) |
| *G09F 3/02* | (2006.01) |
| *B05D 1/02* | (2006.01) |
| *B65C 3/12* | (2006.01) |

(52) U.S. Cl.

CPC ..... *G09F 3/10* (2013.01); *B65C 3/14* (2013.01); *G09F 19/14* (2013.01); *B05D 1/02* (2013.01); *B65C 3/12* (2013.01); *G09F 2003/023* (2013.01); *G09F 2003/0273* (2013.01); *G09F 2023/0025* (2013.01)

(58) Field of Classification Search

CPC ... B65C 3/12; B65C 3/14; G09F 19/14; G09F 2003/023; G09F 2003/0273; G09F 2023/0025; G09F 3/10; B05D 1/02

USPC ..... 427/421.1–427.4; 40/5

See application file for complete search history.

(56) References Cited

U.S. PATENT DOCUMENTS

| | | | |
|---|---|---|---|
| 1,930,228 | A | 10/1933 | Draper |
| 2,374,371 | A | 4/1945 | Morch |
| 2,398,257 | A | 4/1946 | Schwartz |
| 2,810,978 | A | 10/1957 | Chapman |
| 3,357,770 | A | 12/1967 | Clay |
| 3,686,781 | A | 8/1972 | Calhoun, Jr. |

(Continued)

OTHER PUBLICATIONS

"Pressure Sensitive Labelling on Glass Bottles and Jars", 2009 International Technical Centre for Bottling and related Packaging 112-114 Rue La Boetie, 75008 Paris—France www.cetie.org.

*Primary Examiner* — Sonya Mazumdar
(74) *Attorney, Agent, or Firm* — Leason Ellis LLP

(57) ABSTRACT

A lenticular label for a container, such as a curved glass bottle, is formed of a lenticular array having a plurality of lenticules on a front face and a smooth back face and a compliant base layer having first and second faces. A first adhesive is disposed between the first face of the compliant base layer and the smooth back face of the lenticular array. The first adhesive is in substantial contact with both the first face of the compliant base layer and the smooth back face of the lenticular array. A second adhesive is disposed upon the second face of the base layer.

15 Claims, 3 Drawing Sheets

(56) References Cited

U.S. PATENT DOCUMENTS

Figure 1:
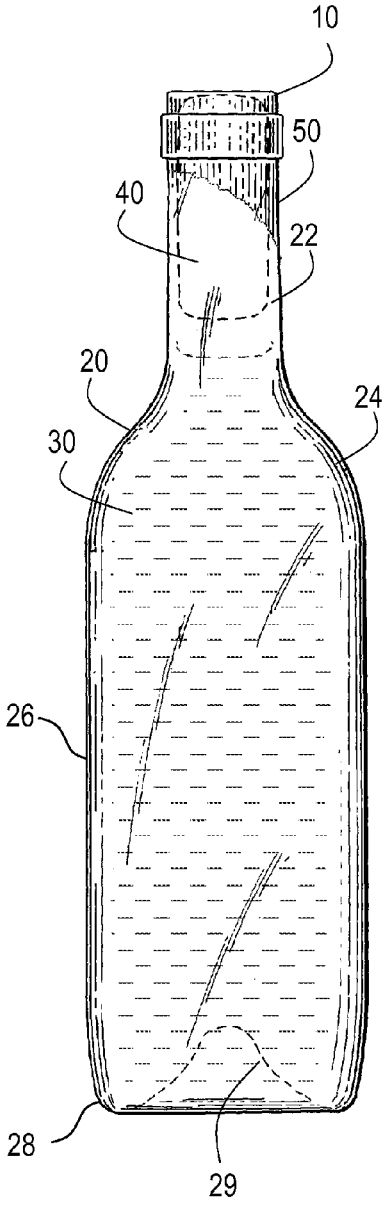

| | | | | |
|---|---|---|---|---|
| 3,856,498 | A * | 12/1974 | Campagna | B05C 19/02 118/503 |
| 4,825,234 | A | 4/1989 | Cai | |
| 5,365,294 | A | 11/1994 | Anderson | |
| 5,494,445 | A | 2/1996 | Sekiguchi et al. | |
| 5,525,383 | A | 6/1996 | Witkowski | |
| 5,600,388 | A | 2/1997 | Anderson | |
| 5,642,226 | A | 6/1997 | Rosenthal | |
| 5,695,346 | A | 12/1997 | Sekiguchi et al. | |
| 5,704,061 | A | 12/1997 | Anderson | |
| 6,796,352 | B1 * | 9/2004 | Geurtsen | B65C 3/16 156/443 |
| 9,302,933 | B2 * | 4/2016 | Myers | C03C 17/007 |
| 2004/0105948 | A1 * | 6/2004 | Kiraly | B32B 7/06 428/40.1 |
| 2005/0100667 | A1 * | 5/2005 | Mayer | C03C 17/002 427/248.1 |
| 2011/0305881 | A1 * | 12/2011 | Schultz | A61L 33/0088 428/195.1 |
| 2013/0133532 | A1 * | 5/2013 | Kian | B65C 9/1803 101/35 |
| 2013/0323468 | A1 * | 12/2013 | Myers | C03C 17/007 428/143 |

* cited by examiner

LAMINATED LENTICULAR LABEL FOR CURVED CONTAINERS

CROSS-REFERENCE TO RELATED APPLICATION

This application claims the benefit of U.S. patent application Ser. No. 62/123,040, filed Nov. 5, 2014, which is hereby incorporated by reference in its entirety.

BACKGROUND

In the past, lenticular labels have tend to be as thin as possible, as thin material may most readily be made compliant with a container having a curved surface. However, this strategy is limiting, as the optical effects associated with lenticular imaging, such as animation or three-dimensionality, are limited both by the width of the lens and the corresponding fraction of the print resolution available beneath each lens. Other factors being constant, a larger lens can provide more phases of animation or more illusory depth, and can therefore gain greater consumer attention.

Speaking more generally, a larger lens can incorporate more striking optical effects and make a more effective sales device. However, such lenses tend to be proportionally thicker and therefore more difficult to apply and retain in reliable compliance with a curved container. This is particularly the case with beverage bottles such as wine, beer, or soft drinks, where labels are often applied to filled bottles that must be kept below a designated threshold temperature.

Government regulations often forbid the treatment or labeling of open bottles for fear of contamination of their contents. While ensuring consumer safety, such restrictions can further increase the challenge of providing a reliable means of adhering a label to a bottle, since the bottle cannot be overheated once filled.

Particularly, a lenticular lens sheet will, at a relatively low application temperature, be more resistant to conforming to the bottle's surface. This resistance to deflection can make the label more prone to lift at its periphery. Lenticular labels have a resolution that is limited by the lens pitch. In retail situations, lenticular lenses are typically disposed vertically, either to exhibit a depth effect, or to animate the image as a potential buyer walks past. In the case of a lenticular label, proper labeling therefore often requires a relatively generous horizontal area. However, a label that wraps around a larger portion of a bottle's transverse radius will be more prone to lifting at the edges. It may be appreciated by the foregoing discussion that the nature of lenticular materials and processes presents distinct technical demands.

While these matters are specific to lenticular printing, lenticular labels are not immune to more general issues relating to label adhesion on glass vessels, and, indeed, often exhibit more criticality.

Empty glass containers, such as beverage bottles, generally emerge from their original forming processes with smooth, continuous surfaces. Such containers, as a rule, have their greatest strength and structural integrity when newly made and free of nicks and scratches. However, just as a sheet of glass will fracture on a line after a light scoring, a glass container may be prone to break at any defect in its surface. Once initiated, such a break can cause the vessel to crack or shatter.

The manual or automated handling of untreated glass containers can bring containers' exteriors into direct contact with one another in such a way that surface imperfections result. Furthermore, sanitary automated handling equipment often sends the moving glass containers into collision with metal guides or other hard materials. Bottle transport, filling and packaging operations nevertheless require high rates of operation for economic efficiency.

Accordingly, various coatings have been developed to deter any impact or abrasion from imparting a surface flaw. Generally, these coatings prevent marring of the continuous glass surface by increasing the lubricity of the containers' vulnerable convex external surfaces. Once coated, friction between the vessel and any surface it contacts is reduced, and the microscopic blemishes that can lead to catastrophic failure are largely prevented.

It may be appreciated that materials that increase lubricity may also increase the difficulty of securely and reliably labeling a container. Therefore, deriving the right coating formulation, the correct dispersion of the coating upon the glass surface, and the optimal application method for a given combination of glass container and label structure is critical to the percentage of vessels that remain in a saleable state throughout diverse handling steps. In the case of beverage bottles these steps may include bottle transport, conveying, filling, washing, labeling, aging, boxing, shipping, storing, and vending. A label may in some cases be securely adhered by bonding it to itself along an overlapping seam. However, in the case of certain types of beverage bottles, there has been an aversion in the trade to labels of the type that by their nature wrap entirely around the bottle. An open margin along the length of the container is preferred, as it allows consumers to view the amount of its contents remaining in the vessel.

Particular budgetary challenges occur when many factors conspire to reduce the proportion of products that remain in the safe, intact and appealing state necessary to promote the sale of the item. This challenge is particularly acute, for example, in the case of beverage bottles such as wine bottles, which may be exposed to greatly and abruptly varied conditions of temperature and moisture, and which may remain in stock for years before consumption.

Prior art U.S. Patents relating to the use of curved lenticular or barrier images include U.S. Pat. Nos. 1,930,228, 2,374,371, 2,398,257, 2,810,978, 3,357,770, 3,686,781, 4,825,234, 5,365,294, 5,494,445, 5,525,383, 5,600,388, 5,642,226, 5,695,346, and 5,704,061. The methods and understandings of these inventions, and particularly those features relating to the preparation and formation of curved lenticular imagery, are hereby incorporated by reference in their entirety.

The organization CETIE publishes materials relating to the standards and practices of labeling, including beverage label application and testing, for example:

"PRESSURE SENSITIVE LABELLING ON GLASS BOTTLES AND JARS", 2009 International Technical Centre for Bottling and related Packaging 112-114 RUE LA BOETIE, 75008 PARIS—FRANCE www.cetie.org The standards and practices published by CETIE are also hereby incorporated by reference in its entirety.

SUMMARY

The invention proposes a system for a applying a lenticular label to a container, such as a bottle. More particularly, it relates to the application of a lenticular label to a bottle when the lenticular lens stock is of such thickness that the stock resists conforming to the curvature of the container. The present invention describes a multi-ply adhesive arrangement in which two discrete layers of adhesive are made to surround a relatively compliant base material. The compliant base material may be, for example, cellulosic paper, synthetic paper, or polypropylene film.

The use of this layered adhesive material in conjunction with a printed lenticular graphic allows the relatively rigid lenticular stock to be kept in reliable conformity with the body of the container for its effective commercial life.

The structural isolation of the two layers of the adhesive by the intermediate compliant base layer allows the deflection forces within the lenticular material to be distributed between two layers of adhesive. Furthermore, the two separate adhesive layers may be optimized for the differing surface qualities of the subject surfaces.

Therefore as a first matter, the structurally divided double layer of adhesive has been found to allow relatively thick and rigid lenticular material to be held in conformity with a curved surface, such as the cylindrical main body of a glass or plastic bottle. As a second matter, it has been found that the manner and density of application of the bottles' preliminary protective coating is also critical to the dependability of the adhesive bond between the bottle and the inner label adhesive.

As a third matter, because the permissible temperature of the bottle is limited, it has been found advantageous to incubate the preformed labels while they are retained on a roll in order to relax the adhesives and the plastic film layers. This relaxation allows the labels to soften and deflect to a curve. Upon transfer of the label to the bottle, the preformed curvature of the label upon the label web promotes the ready conformity of the lenticular label to the essentially cylindrical body of the targeted containers.

As a fourth matter, it has been found the adhesion of the ink printed on the unlenticulated side of the polymer lens material is optimally enhanced using a primer. This step ensures that the interface between the ink and the planar surface is not destructively stressed by either the die-cutting of the labels, or by the subsequent forming of the printed lenticular label a curved bottle exterior.

It may be appreciated that these features and effects may companionably be made to occur partly or wholly in tandem.

BRIEF DESCRIPTION OF DRAWING FIGURES

Figure 2:
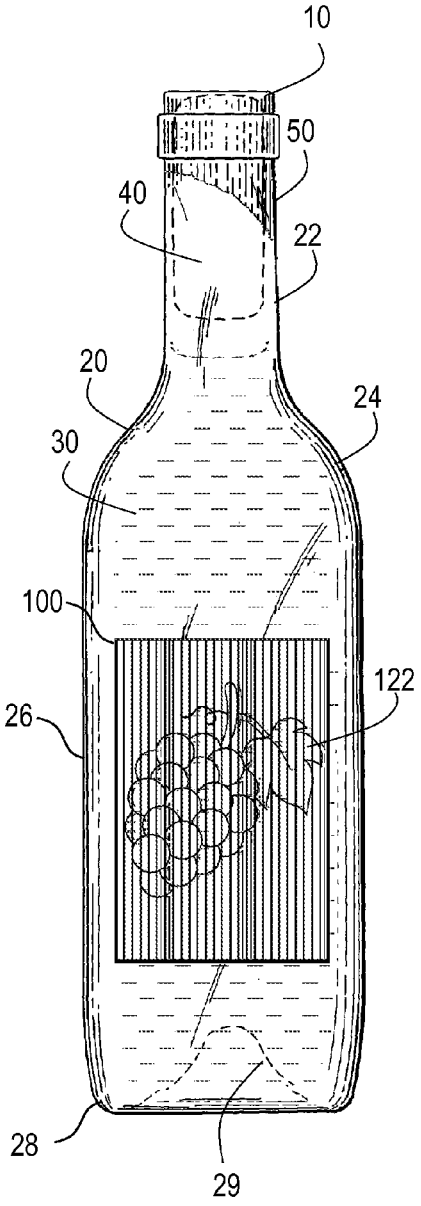
Figure 3:
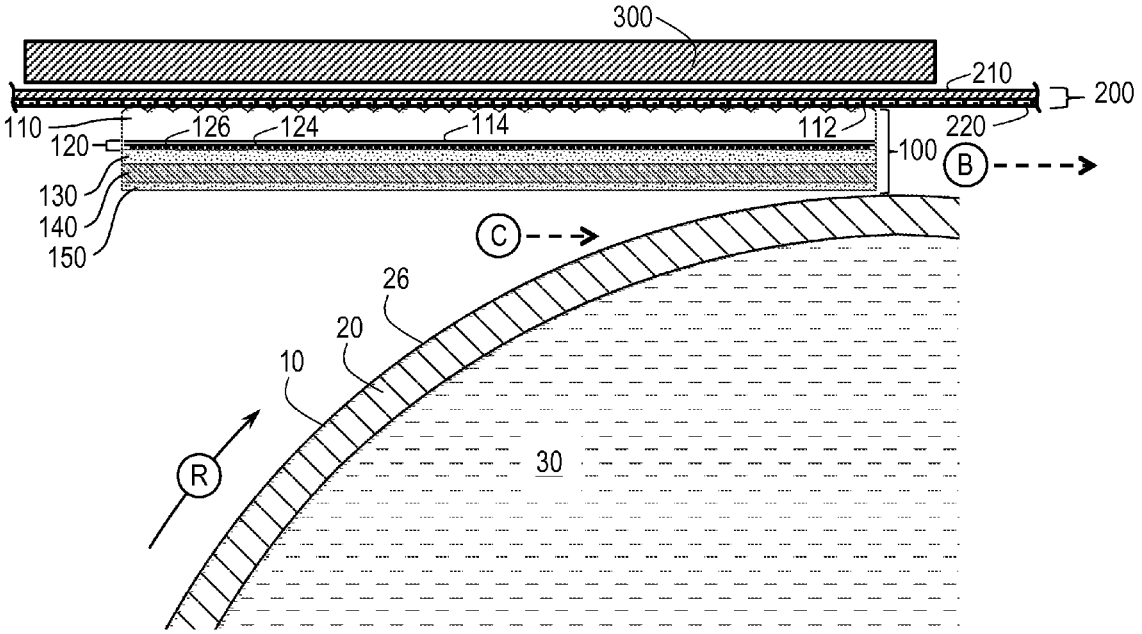
Figure 4:
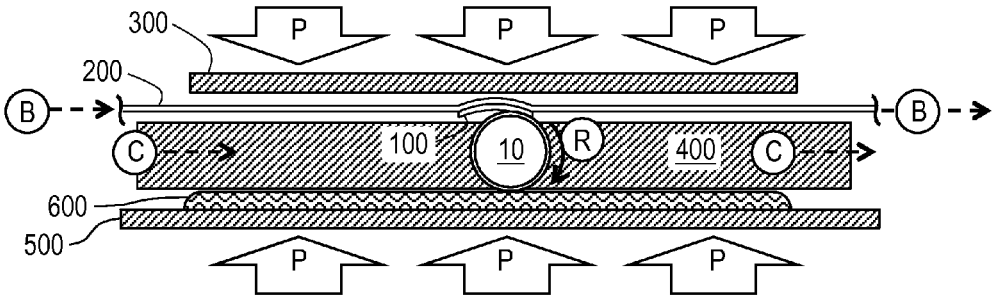
Figure 5:
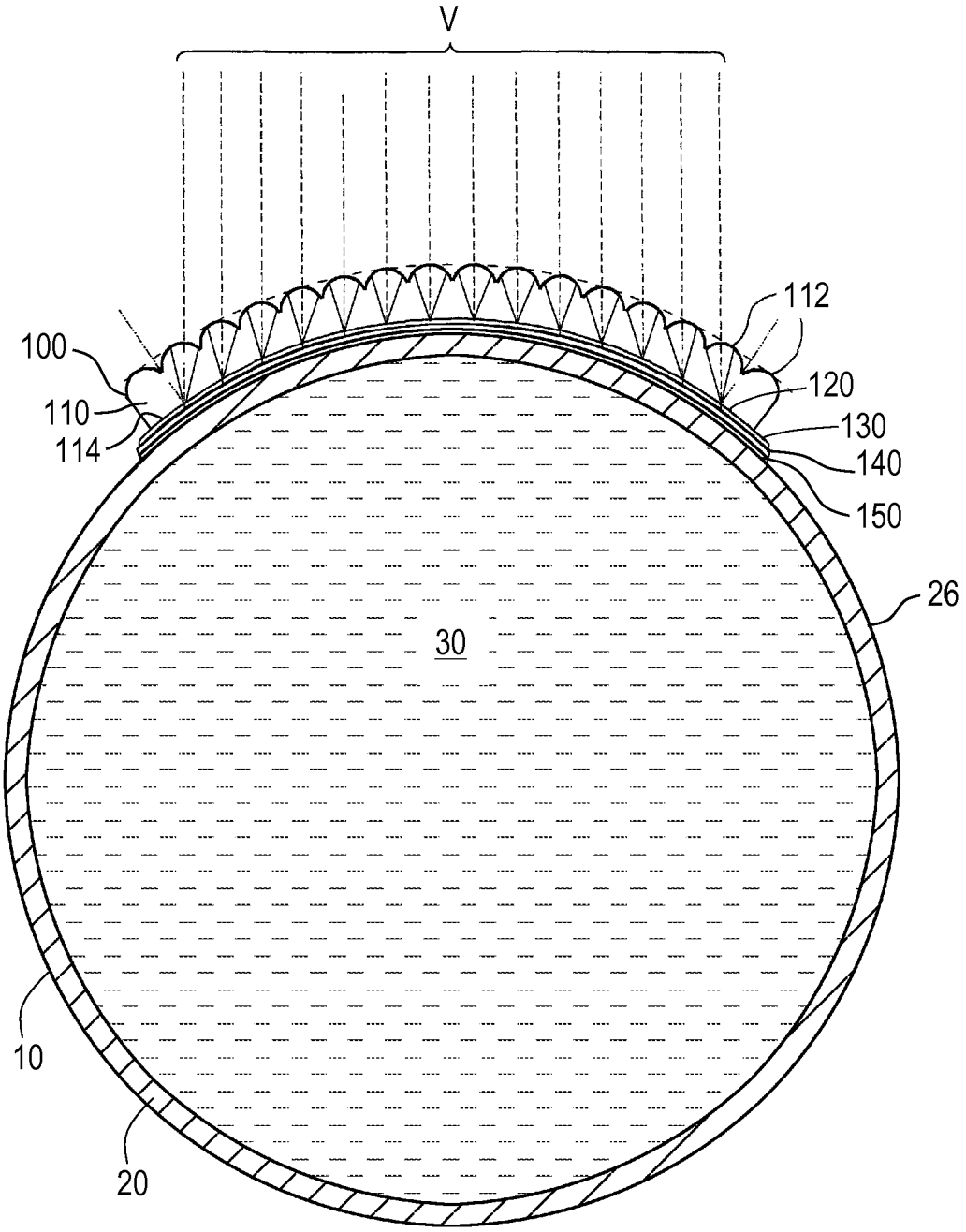

FIG. 1 shows a schematic drawing of a container of a type that may be used within the invention, FIG. 2 shows the container of FIG. 1 after the application of a lenticular label that has been formed and applied in accordance with the invention, FIG. 3 shows schematic diagram showing the application of a lenticular label formed according to the invention to a curved surface of a container, FIG. 4 shows a schematic diagram of the operation a label application line, FIG. 5 shows a schematic sectional view of an assembly completed according to the invention.

DETAILED DESCRIPTION OF CERTAIN EMBODIMENTS

The invention proposes a reliable method for applying lenticular labels to containers. It is amenable for use with glossy materials such as glass bottles. Lenticular materials are particularly challenging to apply to curved containers. Lenticular lens material is generally extruded flat and stored in sheet form.

When lenticular sheet is used as label stock, the material tends to pull away, over time, from the surface of the container to which it has been applied.

Failures of this type have been found particularly difficult to avoid when the lenticular material is of a relatively heavy gauge, for example, having a thickness of 0.3 mm or more (0.012"). Furthermore, when containers are labeled at a relatively low temperature (e.g. 14-16° C.), as is commonly the case with filled beverage bottles, both adhesives and substrates become relatively less compliant, and reliable adhesion becomes more challenging. The invention describes a system that has been found to resolve these difficulties.

Referring now to FIG. 1, the figure shows an exemplary filled bottle of the type commonly employed by wine bottlers. Filled bottle assembly 10 includes glass bottle 20, liquid contents 30, sealing device 40, and foil cap 50. The sealing device in the case of a wine bottle is commonly a real or synthetic cork, but may also be a threaded cap or other mechanical seal. If a threaded cap is employed, it is traditionally primarily made of a metal, e.g., aluminum, but may be of another material such as plastic. The foil cap or coif, which may be wrapped over any type of seal, is usually a metal or plastic, or a combination thereof.

The bottle, while contiguously formed, includes distinct features. Neck 22 may be formed expressly to accept a cork of predetermined length diameter. Shoulder 24 connects neck 22 and body 26, and, in the case of a wine bottle, may be variously formed according to tradition known in the trade so as to indicate the type of wine contained. Body 26 encloses the main volume of the bottle, and is typically formed as a substantially cylindrical length. At base 28, the bottle may depart from cylindrical form and geometrically join with the indented punt 29 in the bottom of the bottle.

Prior to labeling, the glass bottle is typically coated with a polymeric formulation in the form of vapor or spray in order to discourage abrasions and impacts. The coating increases lubricity and provides a slight cushion when bottles come into contact with one another or with a hard surface.

Many coatings have been used for this purpose. Polyethylene is a common and economical choice in the trade as it has a low melting point (104° C.) and is readily liquefied for aerosol application. However, while glass itself is relatively polar, having relatively high surface energy in air, polyethylene is relatively nonpolar, having relatively low surface energy in air.

The contact angle at the edge of a drop of water on a given material is commonly used as an indicator of the material's relative surface energy. At 40° C. (104° F.), the contact angle on clean glass will be approximately 17°, whereas the contact angle on polyethylene at the same temperature will be near 60°. Low surface energy, nonpolar surfaces such as polyethylene therefore tend to resist adhesion. Particularly, it has been found that if the body of the bottle is pervasively and continuously coated with polyethylene, adhesion is of a lenticular label will be unreliable. Typically uncoated glass has a dyne level in the high 40s or low 50s, while monolithic polyethylene film typically yields a surface energy in the range of 30 to 34 dynes. If the bottle is entirely covered, it will simply inherit the low surface energy of polyethylene film.

The percentage of coverage is related not only on the density of the aerosol stream, but also of the application temperature. The aerosolized polymer droplets will spread more at higher aerosol or bottle temperatures, and, for a given application rate and flow rate, will more completely cover the glass surface. Under common application conditions, the resulting polymer flow-out will effectively cover the glass surface, and the resulting surface will be nonpolar, hydrophobic, and not amenable to the application of a relatively stiff label stock such as lenticular sheet.

However, if the surface coverage is incomplete, and some exposed glass sites remain uncovered, those locations will available for polar adhesion. Ideally, in the present invention, it has been found that the polymer coating, at the microscopic level, should resemble an irregular mesh rather than a continuous conformal coating. Owing in part to of the low melting point of polyethylene, such a polymer aerosol may be made to reliably attach to a glass surface having a temperature low as 50° C. (122° F.).

It has been found that this relatively low container temperature minimizes flow-out of the polymer upon the glass, which leaves a high enough proportion of exposed glass that a lenticular label may be made to dependably adhere. At a relatively low container temperature, the microscopic network of polymer droplets will also be relatively raised, which can improve cushioning while also increasing the surface area available to the label adhesive. In the present invention, it has been found that an optimal balance of qualities occurs when the polyethylene coverage is around 90%. At a slightly raised coverage factor of 95%, the lenticular labels were found to regularly fail.

Dyne Testing

Coated wine bottles of two shapes were tested for an adequate dyne level using a dyne pen. The bottle shapes were those known in the trade as WAU and W65. The WAU bottle has a relatively sloped shoulder, and is colloquially known as a Burgundy bottle. The W65 bottle has a relatively square shoulder, and is colloquially known as a Bordeaux bottle.

A 90% coverage of polyester was found to be the utility threshold below which lenticular labels would reliably adhere. Bottles identified as having with 90% coverage were calibrated with a reading from a dyne pen. In testing, the dyne pen was drawn over a two-inch length across the bottle body in the anticipated label area. Bottles bearing a reading beyond the calibrated threshold were subsequently rejected as being incapable of reliably retaining the lenticular label. Bottles with excessive coating densities were cleaned for recoating.

FIG. 2 shows the bottle of FIG. 1 after the application of lenticular label lamination 100. It may be seen that the lenticular label occupies a portion of the relatively cylindrical body 26 of bottle 20. An observer will see a changeable lenticular image 122 that will vary with the observer's relative viewpoint. In the illustrated case, the lenticules are depicted as being oriented vertically, so that, for example, the changeable impression will be perceptible to a viewer moving horizontally, as when the container is upright in a store display. More specifically, the effects of binocular stereoscopy and horizontal parallax may only be seen when lenses are disposed in this orientation.

It should be understood that the layering of the lenticular array 110, first adhesive layer 130, the compliant polymer base stock 140, and second adhesive layer 150 may be effected in various orders of operation without departing from the spirit and intent of the present invention.

It will be appreciated that the first and second adhesive layers 130, 150 at least substantially cover (e.g., largely cover and in some embodiments, the coverage is at least 80%; at least 90% or at least 95%) the respective surfaces of the compliant polymer base stock 140 and in particular, in one embodiment, each of the layers 130, 150 covers the entire respective surface of the compliant polymer base stock 140.

Irrespective of the order of lamination steps, the labels are cut to shape from either pre-assembled sheets or a pre-assembled web of the laminated material. In the case where labels are cut from sheet, the may be mounted on a web carrier after the label profiles have been cut. While the label shown in FIG. 2 is depicted with square corners, it may be preferable in some cases, and particularly with relatively thick lenticular lens sheet, to include a radius at the corners of the label. A rounded corner can in some circumstances prevent the initiation of lifting at the extremity of the label.

The label shape is not restricted to simple geometries, and may, for example, follow the contour of a graphic design. The compliant base film need not be white or opaque, and may be transparent, so that the apparent contour of the label differs from the actual extent of the lens material or the compliant base film. In such as circumstance, the printing on the planar reverse of the lenticular array may be made sufficient to impart the desired opacity, coloration, and overall graphic effect.

The election of polypropylene as a base film is conscientious. Conventional base films for two-sided pressure-sensitive adhesives (PSAs) are instead commonly made of polyester, which is chosen for its stiffness and ability to resist buckling. However, this stiffness has been found to be a disadvantage in the application of lenticular label materials, as the rigidity of the polyester can amplify the tendency of the lenticular material to revert to a planar state and pull away from the bottle. Furthermore, the added mechanical resistance can prevent a complete bond from occurring at the interface between the container and its label, owing to the counter-force of the excessively stiff base film against the force imparted between the web platen and the pad platen's resilient facing.

FIG. 3 and FIG. 4 illustrate the structure and mechanism of the present invention as an exemplary bottle approaches a roll-down station. For the clarity of structural depiction, FIG. 3 shows lenticular label lamination 100 as being planar. However, it should be appreciated that, as shown in FIG. 4, it is an aspect of the invention that the labels be preheated and relaxed into a curved state prior to being applied the their recipient containers. FIG. 4 should also be understood as schematic, as the automated application station might concurrently include a plurality of containers in the various stages of being labeled.

At a roll-down station, containers are made to revolve in direction R by the cooperative effect of support web 200 moving in direction B and conveyor 400 moving in direction C, as shown in FIG. 4. Support web 200 moves at a greater speed than conveyor 400. Owing to the speed difference, a bottle assembly 10 borne on the conveyor 400 and made to bear against support web 200 will spin an a clockwise direction R, as viewed from above.

Support web 200 acts as a carrier for a succession lenticular label laminations 100, which may number in the hundreds or thousands. The assembly comprising the web and the series of labels may be stored upon a spool in roll form. Support web 200 includes web base 210, which may be, for example, craft paper or polymer film, and a means for retaining the label stock against the web base. In the illustrated embodiment of the invention, the lenticulated side of the label is impermanently retained against support web 200 by low-tack adhesive 220 applied pervasively to one side of web base 210.

Clockwise rotation in direction R allows an exemplary adhesive-backed lenticular label lamination 100 to be drawn off low-tack adhesive 220 upon support web 200 and onto bottle assembly 10. Pressure P is imparted between moving support web 200 and bottle assembly 10 by stationary web platen 300 and stationary pad platen 500. Rigid pad platen 500 is faced with resilient pad 600. The resilient pad may be variously formed, and may include, for example, one or more layers of open- or closed-cell foam, stiffening layers of metal, plastic, plywood, or cardboard, or contact facings of low-friction or durable material such as nylon, Teflon (PTFE), or woven fiberglass.

In the label application process, the platen assembly bears in axis P against a moving support web 200 to which individual labels have been temporarily mounted. Mounting may be by a temporary adhesive, as shown, or, alternately, by mechanical means such as tabs in the supporting web. In operation, moving support web 200 is put in motion in linear direction L by a series of motorized spools, and may additionally be guided by pins, spindles or idle rollers.

Owing to the greater bond between the label adhesive and the container, relative to the temporary bond between the lenticulated label face and the moving web, the label is drawn off the moving web and onto the curved body of the container. The regulation of the pressure in axis P is made in accordance with the label and container materials, and their compatibly chosen adhesives.

The structure of the adhesive lamination is essential to the effective operation of the present invention. Referring again to shown in FIG. 3, lenticular label lamination 100 includes lenticular array 110. The lenticular array is typically formed of a transparent polymer such as polyethylene terephthalate (PET) or glycolized polyethylene terephthalate (PETG). However, other polymers may be used, such as vinyl, acrylic, styrene or polycarbonate.

Lenticular stock material exemplified by lenticular array 110 includes a plurality of lenticules 112 on the outer face and a planar back surface 114. The planar back surface is therefore amenable to printed layers 120. The printed layers may include spot or process inks as color separations, but may also include flood coats such as primers, sealers, barriers, adhesion promoters, or one or more white background layers. Exemplary continuous primer layer 124 is shown adhered to planar back surface 114. Clear primer #52997 from Ashland Chemical [Covington, Ky., USA] has been found effective in the application of the present invention, as it prevents separation of the ink from the lenticular material. Printed image 126 is shown applied to primer layer 124. At least a part of printed image 126 includes graphic material arranged so that a variable effect may be exhibited in cooperation with the lenticular optics. At present, the most common procedure is to computationally interlace a series of source images and then print the resulting image in registration on the reverse of the array. The practice of interlacing for various changeable visual effects is well established in the art, and the range of effects in past and current practice are included here by reference.

The label of the invention employs a lamination with two discrete layers of adhesive and an intermediate compliant base film. In the illustrated embodiment of the invention, the printed lenticular material is prelaminated to compliant polymer base stock 140, such as white polypropylene having a thickness between 0.050 mm and 0.075 mm (0.002" and 0.003"). First adhesive layer 130 bonds the printed lenticular image to the base stock. Second adhesive layer 150 ultimately bonds lenticular label lamination 100 to the curved surface of the container.

Beverage container adhesive are known which range in application thickness from 0.01 mm to 0.075 mm. In the invention, it has been found that the thickness of first adhesive layer 130 may advantageously be approximately 0.075 mm (0.003"), while second adhesive layer 150 may be 0.015 mm (0.0006"). This combination provides a close adherence between the compliant stock and the container, while allowing a degree of elasticity between the relatively rigid lenticular array and the relatively compliant base stock.

Lenticular lens sheet is most commonly manufactured by extrusion, and great case is taken to ensure the flatness of the lenticular sheet material. This flatness is advantageous for the great majority of lenticular applications, but presents challenges when the material is to be conformed to curved surfaces. It has been found that specific steps may be taken in conjunction with the labeling process to ensure the reliable fixing of the lenticular label material to the glass containers.

Initially, the joining of label lamination 100 presents a difficulty, in that the polymer memory of the relatively rigid lenticular stock tends to be reinforced by the adhesion of lenticular array 110 to polymer base stock 140. Winding the laminated label stock on a spool with the lenticulated surface facing outward on the spool subsequent to label lamination and storing the roll in this state was found in and of itself to be insufficient to remove the combined memory effect of the lenticular array when joined to the base layer.

Prior to application, the lenticular label roll stock was therefore heated in an incubation oven for approximately eight hours at 32° C. (~90° F.). The long incubation period induces the polymer and adhesive layers to soften and deflect to the extent that much of the planar memory effect is lost. It was found that the laminated lenticular lens stock instead conforms largely to its radius of curvature on the spool.

The labels are then removed from the incubator and immediately installed in the automated application device. In mounting the roll of laminated lenticular label material, it may be necessary to allow for a sacrificial length of leader, as this length may be drawn away from the thermal mass of the incubated roll during installation of the roll on the labeling equipment. Once the leader has passed through the equipment, containers may be loaded into the conveyor system and the labels applied.

As noted earlier, the aerosol application of polyethylene at a relatively low density and relatively low glass container temperature, while permitting access to relatively high surface energy exposed sites on the glass exterior of the container, leaves a microscopic open polymer network in relief on the container. To be effective, second adhesive layer 150 intermediate between polymer base stock 140 and the glass container, must be made sufficiently conformal that the adhesive attach at the exposed sites. These are typically recessed relative the polyethylene network. Given that second adhesive layer 150 may be relatively thin, it may be especially appreciated that the incubation period will facilitate bonding to the relatively sparse distribution of recessed high surface energy sites on the exterior of the container.

Testing

Testing of the durability of labels applied in accordance with the system of the invention was performed according to the following regimen:

The labels were first incubated at 32° C. for eight hours as described above. The roll of label stock, i.e. the laminated, printed lenticular labels mounted located on the liner, was unwound from the spool to the 5th or 6th label on the leading edge of the label stock. A was lifted label half-way off the liner on the trailing edge as defined relative to the label placement on the bottle. A piece of plastic shim stock 0.5 mm (~0.02") thick and 38 mm (~1.5") wide×108 mm (~4.25") high was placed onto the label adhesive under the trailing edge of the labels, justifying the trailing edge to the edge of the plastic shim, the dimensioning of the shim being devised so that a small tab of the shim is left both above and below the modified label.

As prepared, this shim effectively covers more than one third of the adhesive the labels. Since the shim stock is visible above and below the label, the specially prepared test labels may be observed throughout their automated application. The normal process of adhering the label stock onto the bottles was performed through the automated process. The bottles having the test shims inserted beneath their labels were removed and set aside in normal ambient conditions for 24 hours. A clamp was securely fastened to the loose section of the bottle label bearing the plastic shim. The bottle was then suspended so that the full bottle weight was entirely supported by the remaining two-thirds of the label area. It had been established empirically that if the bottle did not separate from the label within two hours, that the adhesion would not fail in its typical commercial lifetime. In this test, the lenticular label application system resisted separation, on average, for approximately eight hours.

It may therefore be appreciated, that, in combination, the lamination described in the present lenticular label lamination and application system allows the label assembly to conform to a glass container by largely alleviating the forces resisting conformity of the inherently flat lenticular array material to the curved container surface.

FIG. 5 shows a schematic sectional view of an assembly completed according to the invention. Lenticular label lamination 100 is shown wrapped around body 26 of bottle 20 within prefabricated filled bottle assembly 10. In FIG. 5, the layers between lenticular array 110 and the surface of bottle 20 are depicted as extending beyond the edge of the array.

While this effect may be taken to be exaggerated, and may not be visible at all in a realized application of the invention, the detail is included to depict the shifting of the relative position of the adhesive and base layers relative to the lenticular material. The composition of the adhesive should be selected so that a degree of migration can be allowed to occur between the layers, so that the layered structure may shift slightly and thereby be more readily retained in compliance with the curve surface of the container. It has been found that when lenticular labels are applied in the form and manner described above, the base film can be bonded to the lenticular sheet without the bubbles, creases, or voids that might detract from the visible lenticular image.

FIG. 5 also shows the display of the completed lenticular label to a viewer V. While not absolutely required by optics, lenticules 112 are typically designed to converge at their effective focal length upon the interlaced image. Interlacing may be achieved by known methods to reflect the curved geometry shown. Furthermore, while the dashed sight-lines from lenticular print are, for simplicity, drawn parallel, the interlacing may be executed with an understanding of a finite viewing distance. In this case, the sight-lines shown would be constructed to converge at the eye of the anticipated viewer.

MODIFICATIONS, RAMIFICATIONS, AND SCOPE

Within the invention, the compliant base film may be supported by a stiffer, less compliant, temporary release liner (not shown), so that the base film may be held flat until it has been adhered to the printed lenticular sheet. The release liner may be present on each label unit, or may be applied collectively to the web of labels. In either case, the liner may be peeled away before the label contacts the bottle. The release liner may be polyester or other relatively rigid material, as the liner is removed prior to the wrapping of the label about the container.

Recommended practices for labeling filled bottles should be followed during the application of labels formed according to the invention. Normal care should be taken to control air temperature, humidity and fill temperature to prevent condensation on filled bottles. Water should be removed from the bottle surface as surface energies are altered in the presence of water. Water removal may be achieved by air knives impinging on the bottles just before arriving at the labeling head.

The risk of bubbling or other incomplete adhesion can be higher than normal when a bottle's surface irregularities are encountered, for example, around any embossings or seam areas. More rigid labels, such as lenticular materials, can therefore have difficulty conforming in these areas. The layered label of the invention allows a secure bond to be made using lenticular material even in such circumstances, owing to the increased conformability of the layered adhesive.

Amendments to the process which may improve bonding in cases where bottle irregularities are present includes additional pressure during label application, stiffening pads or bearing plates, or the conscientious installation of segmented wipers with horizontal divisions.

Some elements of the invention may be acquired in prefabricated form. For example, a white polypropylene label stock is available as Product #FLX000146 FLEXcon (Spencer, Mass., USA) which is amenable for use as beverage label stock and as a self-adhesive, compliant base layer within the invention. FLEXcon #FLX000146 is precoated with an acrylic PSA expressly formulated to withstand a wide of temperature range and may be used effectively for labeling glass bottles.

More generally, adhesives that are suited to beverage labeling and are suitable for use in coating operations within the invention include ROBOND PS-8276 (Dow Chemical, Midland, Mich., USA); FASSON S517N; FASSON S7400 (Avery-Denison, Pasadena, Calif., USA); Optal XP (Henkel, Dusseldorf, Germany); and MP238 (MACtac, Stow, Ohio, USA). Adhesives may be clear permanent polymer-based PSAs designed expressly for beverage packaging and its associated processes, e.g., pasteurization, refrigeration, or various types of water exposure. Acrylic is a common polymer used as the basis for these label adhesives, although other polymer formulations are used as well.

The adhesives used within the invention need not be pressure-sensitive. Adhesives may be applied with the aid of various reagents and activators, including chemical catalysts, heat, and radiation from such other sources as electron beams and ultraviolet sources.

The invention therefore should not be taken to be constrained by the examples described in application, but rather should be understood to be limited only by the broadest reading of any claims, whether included here or whether subsequently appended in the pursuit of this application and any of its dependent, divisional or derivative forms.

What is claimed is:

1. A method for joining a glass vessel with a lenticular label comprising the steps of:

applying an aerosolized polymer to at least one portion of an exterior of the glass vessel;

forming at least one lenticular label that includes: a) a lenticular array having a lenticulated side and a planar side, b) interlaced printing upon the planar side, c) a polymeric base stock, d) a first adhesive joining the interlaced printing on the planar side of the lenticular array to one side of the polymeric base stock, e) a second adhesive also disposed upon the polymeric base stock located on the side opposite the side on which the first adhesive is located, incubating the at least one lenticular label while the at least one lenticular label is wound about a spool; and applying the at least one lenticular label to the at least one portion of the exterior of the glass vessel by applying pressure to the at least one lenticular label to cause the at least one lenticular label to be applied to the glass vessel.

2. The method of claim 1, wherein the step of applying the aerosolized polymer forms a polymer coating on the at least one portion of the glass vessel, the polymer coating covering approximately 90% of glass vessel in the at least one portion of the exterior of the glass vessel.

3. The method of claim 2, wherein at a microscopic level, the polymer coating resembles an irregular mesh.

4. The method of claim 1, wherein the polymeric base stock extends beyond both ends of the lenticular array after the at least one lenticular label is applied to the glass vessel.

5. The method of claim 1, wherein the step of applying the at least one lenticular label to the glass vessel comprises the steps of:

carrying the at least one lenticular label with a first transporting assembly;

carrying the glass vessel with a second transporting assembly; and imparting pressure between the first transporting assembly and the glass vessel by a first stationary platen and a second stationary platen, wherein the first and second transporting assemblies are disposed between the first and second stationary platens and move in axial direction relative thereto.

6. The method of claim 5, wherein the first transporting assembly comprises a support web that moves in the axial direction and includes a low-tack adhesive layer along an exposed surface thereof, wherein the low-tack adhesive layer is configured to temporarily retain the lenticular array against the support web until the at least one lenticular label contacts the glass vessel and the pressure is applied thereto to transfer the at least one lenticular label to the glass vessel and wherein the second transporting assembly comprises a conveyor that moves in the axial direction such that the support web and the conveyor travel parallel to one another.

7. The method of claim 6, wherein the support web travels at a greater speed than the conveyor resulting in the glass vessel rotating when the pressure is applied to the glass vessel to cause it to bear against the support web.

8. The method of claim 5, wherein the first stationary platen comprises a stationary web platen positioned such that the support web travels below a bottom surface thereof and the second stationary platen comprises a rigid pad platen faced with a resilient pad that faces the second transporting assembly and the glass vessel.

9. The method of claim 1, wherein the glass vessel comprises a wine bottle.

10. The method of claim 1, wherein the polymeric base stock comprises a compliant base.

11. The method of claim 1, wherein a layer of the second adhesive has a first thickness and a layer of the second has a second thickness that is less than the first thickness.

12. The method of claim 11, wherein the first thickness is approximately 0.075 mm and the second thickness is approximately 0.015 mm.

13. The method of claim 1, wherein the step of incubating the at least one lenticular label comprises the step of inserting the at least one lenticular label into an incubation oven and the at least one lenticular label comprises a lenticular label roll stock formed of a plurality of lenticular labels.

14. The method of claim 13, wherein the lenticular label roll stock is heated in the incubation oven at a temperature of about 90° F.

15. The method of claim 14, wherein the lenticular label roll stock is heated in incubation oven for about 8 hrs.

* * * * *